US008398420B2

(12) United States Patent
Watson

(10) Patent No.: US 8,398,420 B2
(45) Date of Patent: Mar. 19, 2013

(54) HIGH TEMPERATURE POTHEAD

(75) Inventor: Arthur I. Watson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 13/169,006

(22) Filed: Jun. 26, 2011

(65) Prior Publication Data

US 2012/0052721 A1 Mar. 1, 2012

Related U.S. Application Data

(60) Provisional application No. 61/360,233, filed on Jun. 30, 2010.

(51) Int. Cl.
*H01R 13/52* (2006.01)

(52) U.S. Cl. ..... 439/275

(58) Field of Classification Search ..... 439/275, 439/519, 587, 271, 276
See application file for complete search history.

(56) References Cited

U.S. PATENT DOCUMENTS

| | | | | |
|---|---|---|---|---|
| 3,980,369 | A * | 9/1976 | Panek | 439/204 |
| 4,572,299 | A * | 2/1986 | Vanegmond et al. | 166/385 |
| 4,665,281 | A * | 5/1987 | Kamis | 174/102 R |
| 4,859,200 | A * | 8/1989 | McIntosh et al. | 439/275 |
| 5,700,161 | A * | 12/1997 | Plummer et al. | 439/587 |
| 6,397,945 | B1 | 6/2002 | Manke et al. | |
| 6,409,485 | B1 | 6/2002 | Ebner | |
| 6,910,870 | B2 * | 6/2005 | Ebner | 417/422 |
| 7,575,458 | B2 * | 8/2009 | Parmeter et al. | 439/271 |
| 7,611,339 | B2 * | 11/2009 | Tetzlaff et al. | 417/422 |
| 7,789,689 | B2 * | 9/2010 | Frey et al. | 439/275 |
| 7,959,454 | B2 * | 6/2011 | Ramasubramanian et al. | 439/201 |
| 7,980,873 | B2 * | 7/2011 | Emerson | 439/191 |
| 2004/0120837 | A1 | 6/2004 | Ebner | |
| 2006/0213665 | A1 | 9/2006 | Ebner | |
| 2008/0064269 | A1 * | 3/2008 | Parmeter et al. | 439/733.1 |
| 2009/0269956 | A1 * | 10/2009 | Frey et al. | 439/275 |

OTHER PUBLICATIONS

International Search Report and Written Opinion to PCT Application No. PCT/US2011/041941 dated Feb. 17, 2012.

* cited by examiner

*Primary Examiner* — Amy Cohen Johnson
*Assistant Examiner* — Vladimir Imas
(74) *Attorney, Agent, or Firm* — Jim Patterson

(57) ABSTRACT

A technique enables protection of electrical conductors in a submerged environment, such as a wellbore environment. A connector system is employed to connect a submersible component with an electrical cable. The connector employs redundant seal systems designed to maintain functionality during the life of the system when utilized in high temperature environments. For example, the high temperature, redundant seal systems enable continued operation of the submersible component in a submerged environment of at least 600 degrees Fahrenheit.

16 Claims, 3 Drawing Sheets

HIGH TEMPERATURE POTHEAD

CROSS-REFERENCE TO RELATED APPLICATION

The present document is based on and claims priority to U.S. Provisional Application Ser. No. 61/360,233, filed Jun. 30, 2010.

BACKGROUND

In a variety of well related applications, electric power is delivered downhole to a submersible component. For example, power cables may be routed down through a wellbore for connection with a submersible motor of an electric submersible pumping system. The lower end of the electric cable is connected with the submersible component by a connector system, often called a pothead system.

Existing pothead systems generally comprise a metal pothead body through which the power cable conductors are routed. Terminal ends of the power cable conductors extend from the pothead body for insertion into corresponding conductor receptacles of the submersible component. Within the metal pothead body, the power cable conductors are sealed against incursion of well fluid or other potentially detrimental contaminants. However, existing configurations and sealing materials are susceptible to leakage when employed in high temperature environments, e.g. high-temperature well environments.

SUMMARY

In general, the present invention provides a technique for protecting electrical connectivity in a high temperature, submerged environment, such as a high temperature, wellbore environment. A connector, e.g. pothead, is employed to connect a submersible component with a cable which provides electrical power to the submersible component. The connector employs redundant seal systems designed to maintain functionality during the life of the system when utilized in high temperature environments. For example, the high temperature, redundant seal systems enable continued operation of the submersible component in a submerged environment of up to 600 degrees Fahrenheit.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
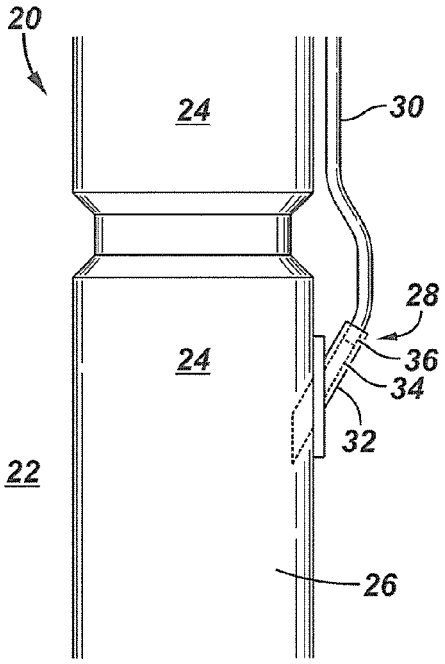
FIG. 1 is a schematic illustration of one example of a connector system engaging an electric cable with a submersible component.

In the following description, numerous details are set forth to provide an understanding of the present embodiments.

However, it will be understood by those of ordinary skill in the art that the present system and methodology may be practiced without these details and that numerous variations or modifications from the described embodiments may be possible.

The present system and methodology relate to submerged connections between electrical cables and submersible components. In one embodiment, a connector system is provided for enabling an electrical connection between a power cable and a submersible component, such as an electric, submersible motor. The connector system utilizes a connector, sometimes referred to as a pothead, which simplifies construction, seals against the one or more internal conductors, and facilitates the formation of a seal with the submersible component.

As described in greater detail below, pothead connectors are useful with electric submersible pump (ESP) motors to connect a power cable to the motor. The connector is called a pothead because it includes a cavity that is potted with a solidifying compound. The assembly of cable and pothead is referred to as a motor lead extension or MLE. The opening in the motor which is adapted to receive the pothead is called a pothole. The pothead may be field-attachable due to the impracticality of shipping and handling the motor with the long cable already attached. The pothead and pothole include adequately insulated electrical terminals. Additionally, the pothead and pothole prevent ingress of well fluid into the motor and prevent loss of motor oil to the wellbore. This capability is enabled in the present embodiments by seal systems that securely seal the pothead to the pothole and the pothead to the cable.

Embodiments described herein provide an improved pothead and motor lead extension design having redundant seals that cooperate with the cable and are functional in applications and service temperatures up to at least 600 degrees Fahrenheit. This allows the pothead to be utilized in high-temperature well environments, such as the environments associated with steam assisted gravity drainage (SAGD) wells, to enhance recovery of hydrocarbons. The cable employed in these designs is insulated with a high-temperature extruded layer and/or with overlapping wraps of high temperature tape, such as polyimide tape with fluoropolymer adhesive. The design is compatible with factory filled motors in which the pothead plugs into the pothole to prevent loss of motor oil and to prevent air from entering the motor.

In one example, an MLE is provided with overlapping wraps of high-temperature, insulated tape, e.g. polyimide tape having fluoropolymer (SEP) adhesive. In this example, a layer of elastomer insulation, e.g. ethylene propylene diene monomer (EPDM), may then be applied over the polyimide tape. An outer lead jacket is then applied over the elastomer insulation. In other applications, the layer of insulation may include (in addition or alternatively) an extruded material, such as an extruded polyetheretherketone (PEEK) material. Additionally, a variety of other types of high temperature materials may be utilized in the cable for sealing with the connector, e.g. pothead.

Regardless of the materials employed to construct the cable and the cable ends located within the connector, the design of the connector features redundant seals between the cable and the pothead to protect and to seal the cable ends in high-temperature environments of up to at least 600 degrees Fahrenheit. For example, a first seal system may comprise a solder joint or a system of solder joints between the lead cable jacket and a housing of the pothead. A second seal system may comprise an O-ring that seals between the insulation layer, e.g. an extruded PEEK insulation layer, of individual phases in the cable and a housing of the pothead. In some embodiments, the O-ring seal system is particularly amenable for sealing against an extruded PEEK insulation layer which has an outer surface of accurately controlled, uniform diameter that is hard, smooth and continuous. However, the O-ring seals may be adapted for use with a variety of other materials including use against lapped tape in certain applications.

ESP motors can be re-filled with motor oil after installation of the pothead and other adjoining pieces, e.g. another motor, a motor protector, or a gauge. However, some motors are not re-filled with oil at installation. This imposes additional functional requirements on the pothole. For example, the pothole should not lose motor oil or admit air between the time the shipping cover is removed from the pothole and the time the pothead is attached. Additionally, the pothead/pothole design should permit equalization of the pressure in the interface between the pothead and the terminal block with the pressure inside the motor. In some applications, the equalization can be accomplished through a valve action of a terminal block located in the pothole. Before the pothead is plugged into the pothole, a spring forces the terminal block upward into a position in which an O-ring seals between the terminal block and the inside diameter of the pothole. The act of plugging in the pothead forces the terminal block downward against the spring until the O-ring enters an enlarged "bleed groove" in the pothole so that the O-ring no longer seals and establishes fluid communication with the motor. At the same time, another O-ring on a snout of the pothead is positioned to seal the pothead to the pothole. This type of pressure equalization assembly, or a variety of other mechanisms, may be used in the embodiments described below.

According to one embodiment of the present connector, a pothead is designed with an additional seal system in the form of a lip seal system having individual elastomer lip seals which seal against individual cable phases, e.g. against three cable phases. In an alternate embodiment, the lip seal system may comprise a unitized elastomer lip seal which seals simultaneously against all of the cable phases and against an inner surface of the pothead housing. In the latter example, the lip seal system may be in the form of an elastomer disc having tapered lips protruding from both faces around the perimeter of the holes for the cable phases and around the outer perimeter of the disc for contact with an inner surface of the housing. Each lip region may be urged against the surface requiring sealing by a mating recess in the face of an adjacent compression block or disc. For example, the mating recess may have a mismatch with the lip in regards to angle, contour, or size that the lip is deflected radially against the surface requiring sealing by an axial force applied to the compression block. The axial force may be generated by a nut, such as a threaded gland nut. Additionally, an intervening spring stack may be positioned between the nut and the compression block. One purpose of the spring stack is to accommodate thermal expansion and contraction of the elastomer lip seal because its coefficient of thermal expansion may be substantially greater than that of the surrounding metal components. The spring stack also prevents extrusion of the lip seal at the higher temperatures experienced in a high-temperature, well environment while further preventing leakage due to underloading of the seal lips at lower temperatures in the cycle. In one example, a single gland nut and a single spring stack are used to simultaneously load all sets of lips, e.g. four sets of lips around the three phases and along the interior surface of the housing.

Another embodiment of the connector is in the form of a pothead having an individual insulating shroud on each of the phases. In this example, the insulating shroud may be formed of a PEEK resin and placed around each of the three phases in a three-phase electrical cable. The shrouds protrude from a lower face of the pothead and serve to insulate the terminals while mating with recesses in the insulating pothole terminal block. Each shroud may be designed to form an insert in the compression disc and may contain a mating recess to compress the lip of the seal. This creates a seal between the shroud and the insulation around the phases to prevent electric arcs from tracking inside the shroud from the terminal to the compression disc or other metal components.

The embodiments described herein enable construction of an MLE assembly with novel materials and design features which facilitate reliable operation in 600 degree Fahrenheit service temperatures. For example, polyimide tape insulation with fluoropolymer adhesive, polyimide components, and perfluoroelastomer seals may be employed for their higher temperature capabilities and their sealing capabilities. Additionally, various novel soft lip seals may be used to seal over the wrapped tape insulation if tape insulation is used. Sealing may further be enhanced through the use of three individual lip seals combined with three individual spring stacks on the three phases. It should be noted that other numbers of seals and spring stacks may be used if other numbers of phases are employed in the electric cable.

Depending on the specific environment and application, the embodiments described herein may comprise several features arranged in various combinations to provide a securely sealed connector in high-temperature service applications. For example, solder joints may be employed to seal between the lead cable jacket and the pothead housing in combination with redundant seals against the cable insulation. The solder joint may be formed initially and then encapsulated in a potting compound. In some embodiments, O-ring seals may be replaced by lip seals. Additionally, the connector design may utilize a spring-loaded gasket or unitized lip seal between the pothead and the terminal block.

In some embodiments, the separate lip seals are used for each individual phase without employing an outer lip seal positioned against the inside surface of the pothead housing. This approach enables use of a reduced volume of elastomer that would otherwise be required to create, for example, the unitized lip seal. Consequently, such a design provides a lower volume of the elastomer subject to thermal expansion and reduces the amount of spring compensation otherwise needed to accommodate expansion and contraction of the elastomer. A spring stack may be employed to maintain compression on the lip seal or lip seals over the range of thermal expansion and contraction and may comprise, for example, multiple wave springs or Belleville springs stacked in parallel and/or series. The parallel stacking may be achieved by a set of springs having nested shapes to multiply the load generated. The series stacking may be achieved with, for example, wave springs by separating multiple stacks of nested springs with stiffer spacer washers to multiply the total deflection. Series stacking can be achieved with Belleville springs by inverting alternate stacks of nested springs.

Examples of other features which facilitate maintaining a sealed connector in a high-temperature environment include shrouds positioned around each individual phase between the terminal and the lip seal associated with each phase. The lower end of the shroud may be designed to mate with a recess in the terminal block. By way of example, each shroud may be formed from a variety of materials, including polyimide resin or ceramic. Polyimide resin provides adequate physical and dielectric strength at service temperatures up to at least 600 degrees Fahrenheit. In some applications, ceramic provides the desirable properties at even higher temperatures.

In some embodiments, the cable comprises conductors which are insulated with overlapping or lapped wraps of tape. In these embodiments, the lip seals may be made of a softer elastomer compound than would otherwise be used to enable the lip seals to better conform to the ridges of the lapped tape insulation. The lip seal or seals may be formed from a variety of materials, such as 75 to 90 durometer fluoroelastomer (FEPM) material. Another example of lip seal material is a 70 to 80 durometer fluoroelastomer (FKM) material. In other applications, the lip seal may be formed from a 60 durometer perfluoroelastomer (FFKM) material. Additionally, the filler material for the soft compound may comprise primarily non-black fillers to retain dielectric properties.

The lip seals also may be coated or overmolded with a softer compound to further facilitate sealing against the ridges of the lapped tape insulation around the phases of the cable. The internal, harder core of the lip seal maintains better resistance to extrusion. Additionally, the lip seals may be treated with a solvent or other agent to soften the outer skin of the elastomer seal which again facilitates sealing against tape insulation or other uneven types of insulation. The lip seals also may be softened by heating the pothead above a specific temperature, e.g. 200 degrees Fahrenheit, after assembly to allow the lip seals to conform to the ridges of the phase insulation. For example, the glass transition temperature for perfluoroelastomers can range above approximately 200 degrees Fahrenheit, at which temperature the material softens.

Because soft seals extrude more easily, the extrusion gap around the insulation of the cable phases is controlled. For example, the size of the corresponding phase openings in an inner metal housing of the pothead can have a relatively tight tolerance, e.g. 0.001 inch, in the section of the opening adjacent the lip seal. If a shroud is employed around the phase, the higher thermal expansion of the shroud can expand the clearance at higher temperatures. The resulting extrusion gap may be blocked by a scarf-cut anti-extrusion ring, such as a polyimide anti-extrusion ring. The interface between such an anti-extrusion ring and the shroud may be less than 90° from the axis so as to wedge the anti-extrusion ring against the insulation layer, e.g. the lapped tape or extruded insulation layer.

Improved sealing also may be achieved when the ridges of the tape insulation are sanded or polished smooth. A solidifying insulating coating may be applied to the tape insulation on the cable conductor. The surface tension of the coating causes it to fill crevices and to smooth out transitions in the tape insulation, thereby improving the sealing function with respect to the lip seals. When combined with sanding, the coating restores insulation strength that may be lost due to the sanding or polishing. By way of example, the coating may comprise polyimide resin in a solvent or vehicle.

Other features designed to facilitate sealed connection in a high-temperature environment may comprise improved seals located on a snout of the pothead. For example, the snout of the pothead may be provided with an improved seal with respect to the pothole by equipping the snout with two O-rings in which one of the O-rings is formed from a perfluoroelastomer or other suitable material designed for temperatures up to at least 600 degrees Fahrenheit. The other O-ring is selected for storage and installation in temperatures as low as −50 degrees Fahrenheit, at which temperature the perfluoroelastomer O-ring may become too inelastic to seal. The perfluoroelastomer O-ring may be equipped with polyimide anti-extrusion back-up rings, while the low temperature O-ring is not so equipped. The purpose is preferentially allowing the low temperature O-ring to extrude under high downhole pressure while protecting the high temperature O-ring from the extrusion.

The female terminal in the terminal block of the pothole may be equipped with an O-ring seal to effect a seal between the terminal and the terminal block that prevents loss of motor oil or ingress of air during installation. A threaded hole may be provided in the terminal to accept a threaded tool for pulling the terminal into place against the resistance of this O-ring. Also, a solid conductor of the cable may be utilized as the male terminal instead of attaching a separate male terminal to the cable conductor by soldering, crimping or threading. In some applications, this approach can prevent joint failure while saving space inside the pothead.

The various features and embodiments of the electric cable connector described above may be utilized in a variety of equipment employed in many types of high-temperature environments. According to one example, the high-temperature connector is used to deliver electrical power to electric motors operated in high-temperature, downhole environments. For example, the connector may be used to couple a power cable with an electric motor of an electric submersible pumping system.

Referring generally to FIG. 1, an example of such an application for the high-temperature connector is illustrated. In this embodiment, a well system 20 is illustrated as deployed in a submerged environment 22, such as a downhole, wellbore environment. By way of example, the wellbore environment may be a high-temperature environment found in a steam assisted gravity drainage well. In this example, system 20 comprises a plurality of components 24 including a submersible, electric component 26. By way of example, submersible electric component 26 may comprise a submersible motor or other component requiring power in the submerged environment 22.

An electrical connector 28 provides an electrical connection between electric, submersible component 26 and an electric cable 30, e.g. an electric power cable or an instrument cable. The connector 28 may be in the form of a pothead 32 coupled to the electric cable 30 to form a motor lead extension (MLE) 34. Alternatively, the pothead 32 may be attached directly to an independent well power cable without an MLE. The connector 28 sealingly encloses one or more internal conductors or phases 36 which carry electrical power to submersible component 26. The phases 36 within connector 28 may be individual end portions of electric cable 30 and/or terminals connected to the end portions of electric cable 30.

Figure 2:
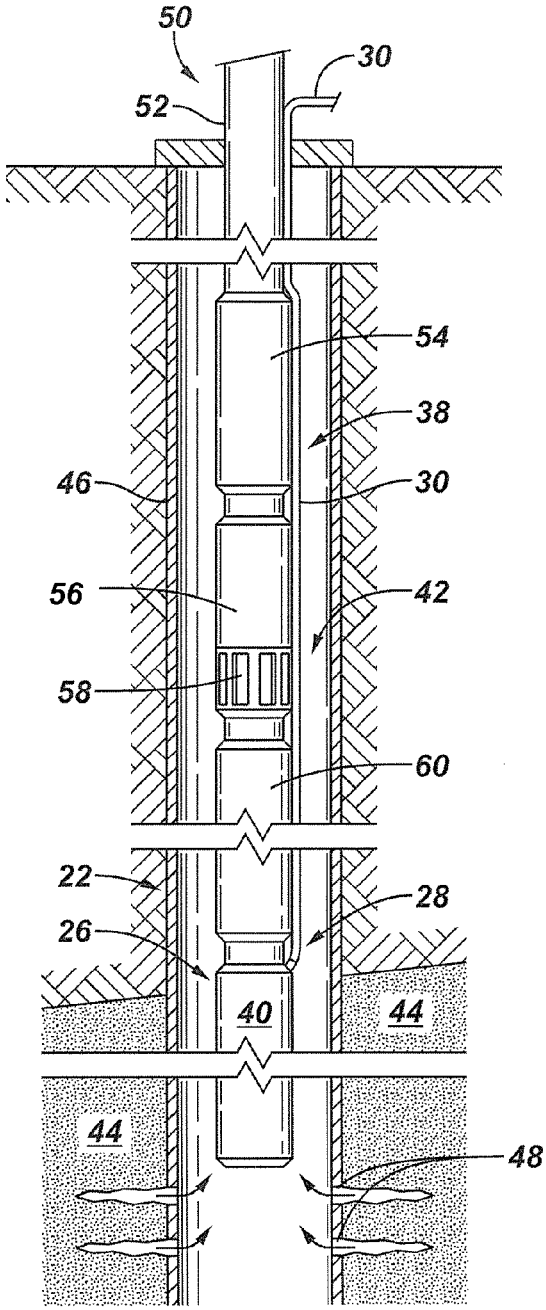
FIG. 2 is a front view of an electric submersible pumping system in which a power cable is coupled to a submersible motor via a connector system.

In the embodiment illustrated in FIG. 2, the connector 28 is in the form of a pothead used to connect electric cable 30 (in the form of a power cable) to an electric submersible pumping system 38. For example, power cable 30 may be connected to an electric submersible motor 40 used to drive electric submersible pumping system 38. In this particular application, the electric submersible pumping system 38 is deployed in a wellbore 42 drilled into a geological formation 44. The wellbore 42 may be lined with a casing 46 that is perforated with a plurality of perforations 48 to allow well fluid to flow into the interior of casing 46.

The electric submersible pumping system 38 is deployed to a desired location in wellbore 42 via a conveyance 50 which often comprises a tubing 52, e.g. coiled tubing/production tubing, or other suitable conveyances. The system 38 is connected to conveyance 50 by a connector 54 and may comprise a variety of pumping related components. For example, electric submersible pumping system 38 may comprise a submersible pump 56 connected to a pump intake 58. The pump intake 58 allows well fluid to be drawn into submersible pump 56 when pump 56 is powered by submersible motor 40. In many applications, a motor protector 60 is located between submersible motor 40 and pump 56 to enable pressure equalization while isolating motor fluid from well fluid.

In the embodiment illustrated in FIG. 2, the power supplied to submersible motor 40 via electric cable 30 is three-phase power and connector 28 is designed to sealingly protect the three phases in a high temperature environment with temperatures up to at least 600 degrees Fahrenheit. Regardless of the particular design of submersible motor 40, connector 28 enables the protected, consistent delivery of electric power from cable 30 to submersible motor 40 in these high-temperature environments. Both the electrical cable 30 and the connector 28 are designed for long-term operation in the wellbore environment which can present not only high temperatures but also high pressures, and/or harsh chemical conditions. It should be noted the submersible motor 40 may be constructed in a variety of sizes and configurations depending on the particular pumping application.

Figure 3:
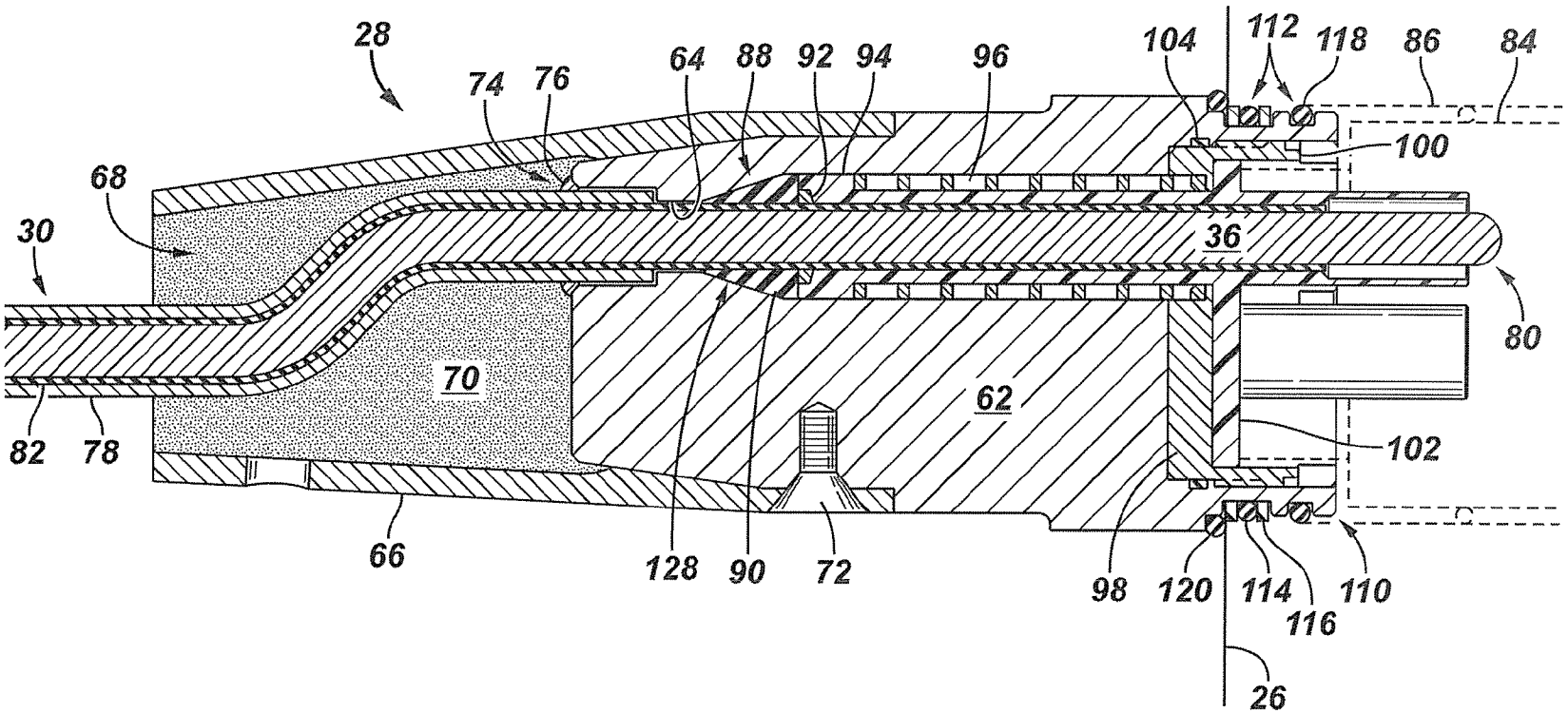
FIG. 3 is a cross-sectional view of one example of a pothead style connector which can be used in submerged, high temperature environments.

Referring generally to FIG. 3, one example of the high-temperature connector 28 is illustrated. In this example, connector 28 comprises a connector housing 62 which forms a seal housing for sealing phases 36 of electric cable 30. The individual phases 36 are received in corresponding openings 64 formed generally longitudinally through connector housing 62. The connector housing 62 is coupled with a cavity structure 66 having an internal cavity 68 which is filled with an encapsulating material 70, such as an epoxy potting material to stabilize and retain the cable and cable phases within the connector. The connection between housing 62 and cavity structure 66 may be in the form of a threaded connection, welded connection, or other suitable connection for securing the components. Additionally, bolts or other threaded fasteners 72 may be disposed through a sidewall of cavity structure 66 for threaded engagement with connector housing 62.

The cable 30 and its individual phases/conductors 36 are disposed within cavity structure 66 and connector housing 62 and sealed therein with a redundant seal system 74. The configuration and materials selected for connector 28 and redundant seal system 74 are designed to enable use of the connector 28 and submersible component 26 in harsh, high-temperature environments with temperatures up to at least 600 degrees Fahrenheit.

According to one embodiment, redundant seal system 74 comprises a metal seal 76, e.g. a solder joint, between connector housing 62 and an outer jacket 78, such as an outer lead jacket, of the cable 30 or cable phases 36. By way of example, the solder joint 76 is located at a first end of connector housing 62 on a side generally opposite from exposed connector ends 80 of phases/conductors 36. It should be noted that although a variety of cables 30 may be employed to deliver electrical power to the submersible component 26, the example illustrated in FIG. 3 comprises a plurality, e.g. three, conductive phases 36 with each phase covered by an insulation layer 82 up to connector end 80. The connector end 80 remains exposed for conductive contact with a corresponding terminal of a terminal block 84 disposed within a pothole 86 of submersible component 26.

As discussed above, the insulation layer 82 may comprise an extruded layer of, for example, PEEK material or another suitable material disposed about each conductive phase 36. In other applications, the insulation layer 82 comprises a lapped tape which is wrapped around each conductive phase 36. By way of example, the tape may comprise overlapping wraps of polyimide tape having a fluoropolymer adhesive. In some embodiments, the tape can be combined with additional insulation layers, e.g. extruded layers or coatings. The outer lead jacket 78 is disposed around the insulation layer 82 and extends partway into connector housing 62. This enables formation of the metal seal 76, e.g. solder joint, between the outer jacket 78 and the connector housing 62 as a first seal system of redundant seal system 74.

The redundant seal system 74 also may comprise a seal system 88 having a seal member 90 which may be a lip seal, e.g. a wedge-shaped or tapered lip seal, combined with a backup ring 92. Seal member 90 is positioned between the connector housing 62, the insulation layer 82 of each conductive phase 36, and a shroud 94. The backup ring 92 may be trapped between the seal member 90, e.g. a wedge-shaped lip seal, the shroud 94, and the insulation layer 82. In the illustrated embodiment, seal member 90 is formed as a lip seal to better provide improved redundancy in redundant seal system 74. The shroud 94 also may serve as a complementary or additional insulation system by insulating each individual phase 36 within connector housing 62. In the example illustrated, shroud 94 extends from seal member 90 into proximity with the tip of connector end 80. The first end of the shroud 94 seals against seal member 90 and the opposite end of shroud 94 mates with a corresponding recess in terminal block 84. Shroud 94 may be made from a variety of suitable materials, such as a polyimide resin which provides suitable physical and dielectric strength at operating temperatures of up to at least 600 degrees Fahrenheit. In some applications, the backup ring 92 may be designed to prevent extrusion of seal member 90 along the interior of shroud 94.

Referring again to FIG. 3, a spring stack 96 may be positioned within connector housing 62 around each shroud 94. The spring stacks 96 are acted on by a compression block or disc 98, and axial force may be generated against the compression block 98 on a side opposite spring stacks 96 by a ring 100 fitting into a corresponding recess in the housing 62. The ring 100 may be a gland nut, retaining ring or other suitable ring member. Additionally, a gasket or seal system 102 may be positioned between compression block 98 and terminal block 84 while surrounding the individual phases 36. In the illustrated embodiment, the gasket/seal system 102 comprises a flat gasket. However, other embodiments may employ a seal, such as a unitized elastomer lip seal which simultaneously seals against the plurality of shrouds 94, against an inner surface of connector housing 62 (or against an inner surface of gland nut 100), and against the inner and outer surfaces of a terminal block 84. Additionally, some embodiments may employ a seal 104, e.g. an O-ring seal, between compression block 98 and housing 62 as part of redundant seal system 74.

Figure 4:
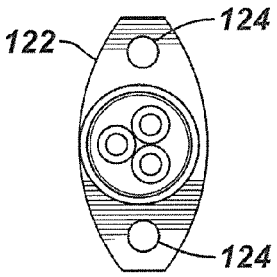
FIG. 4 is an end view of the pothead style connector illustrated in FIG. 3.

With additional reference to FIG. 4, connector housing 62 may be in the form of a pothead housing having an engagement portion 110, e.g. a pothead snout, designed for insertion into pothole 86. The engagement portion 110 also may comprise a portion of redundant seal system 74 in the form of a seal system 112 designed to form a secure seal between the pothead housing 62 and the submersible component 26. By way of example, seal system 112 comprises a first O-ring seal 114 secured with O-ring backup members 116. Seal system 112 also may comprise a second O-ring seal 118 disposed around the engagement portion 110 to provide a backup seal. It should be noted that additional backup seals also may be employed. As discussed above, the seals 114 and 118 may be made from dissimilar materials. For example, O-ring 114 may be formed from a perfluoroelastomer material suitable for temperatures up to at least 600 degrees Fahrenheit. The perfluoroelastomer material is surrounded with backup members 116, e.g. anti-extrusion backup rings, formed of polyimide. The second O-ring 118 may be formed from a variety of materials suitable for low temperatures, such as temperatures as low as −50 degrees Fahrenheit.

An optional, additional O-ring or rings 120 may be positioned to abut a transverse surface of submersible component 26 when connector 28 is secured to component 26. As illustrated in FIG. 4, the connector 28 may be secured to submersible component 26 by a flange 122 having openings 124 therethrough. Bolts or other suitable fasteners may be inserted through openings 124 and threaded into corresponding openings formed in submersible component 26. As the fasteners are tightened, the engagement portion 110 is forced into the corresponding pothole 86 until seal system 112 securely seals and isolates the interiors of the connector 28 and component 26 from the surrounding environment.

Figure 5:
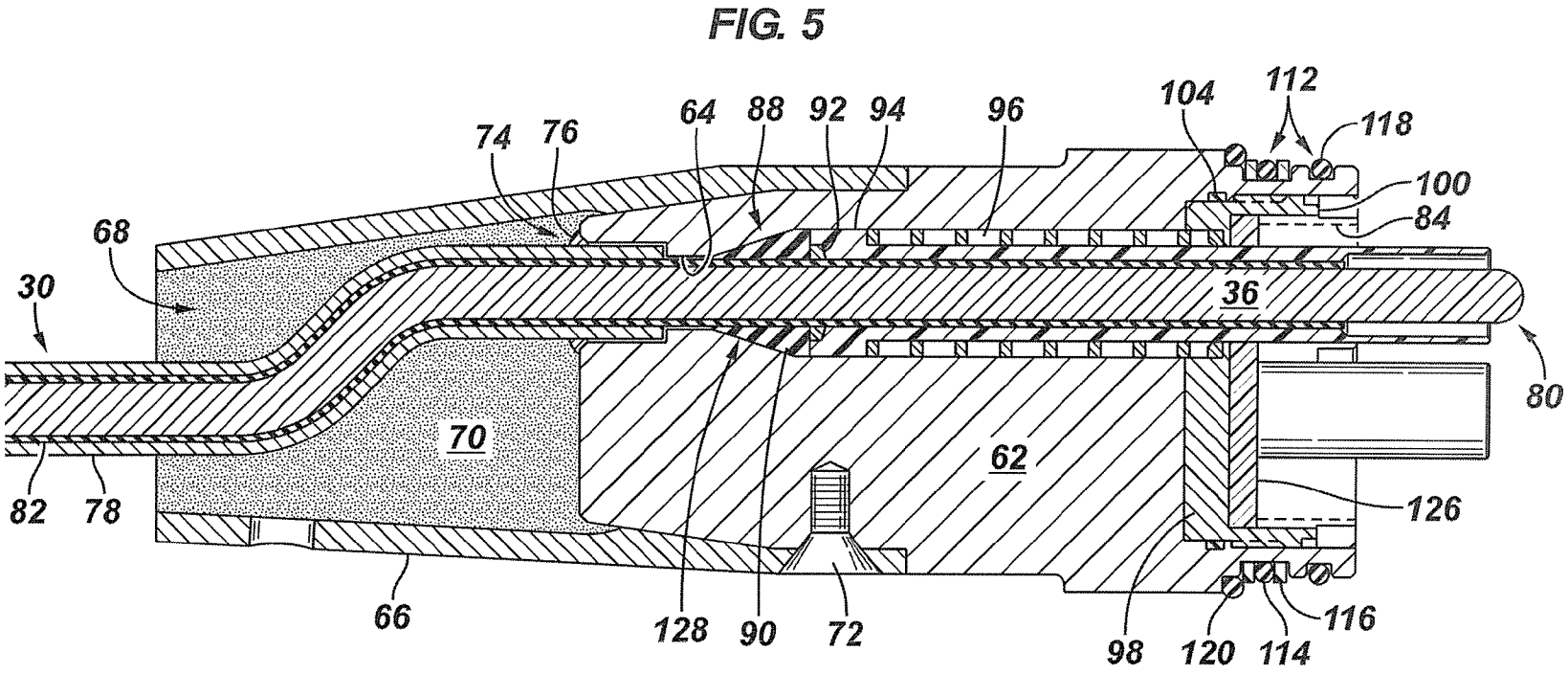
FIG. 5 is a cross-sectional view of another example of a pothead style connector which can be used in submerged, high temperature environments.

Referring generally to FIG. 5, an alternative embodiment of connector 28 is illustrated. Although the alternate connector 28 is substantially similar to the embodiment illustrated in FIG. 3, a few additional features are discussed which can be added to or used as an alternative to features described with respect to the embodiment illustrated in FIG. 3. In this latter embodiment, for example, a unitized elastomer lip seal 126 is used in addition to or in place of gasket/seal 102. By way of example, the unitized elastomer lip seal 126 may have tapered lips protruding from both seal faces around the perimeter of openings 64 receiving shrouds 94, around the inner surface of ring 100, and against the inner and outer surfaces of terminal block 84. The lips are urged against the corresponding surfaces by, for example, mating recesses in the face of the adjacent compression block 98. The necessary axial force is generated by tightening ring 100. It should be noted that the embodiment illustrated may utilize some or all of these features in a variety of combinations. For example, seal members 90 also may be included in this embodiment and may comprise lip seals, O-rings, or other suitable sealing members. Anti-extrusion rings, e.g. an anti-extrusion ring 92, may be used in suitable locations to prevent undesired extrusion of the seal material along the cable phase 36 or through other gaps in the assembly.

In some applications, the unitized elastomer lip seal 126 can be used in addition to or instead of individual lip seals 90. As discussed above, however, the sole use of individual lip seals 90 can be helpful in reducing the volume of elastomer that is subjected to thermal expansion and this reduces the spring force compensation that must be provided by corresponding spring stacks. Additionally, the individual lip seals 90 may comprise an outer region or skin 128 which is a softer material than the internal support material (see FIGS. 3 and 5). For example, the outer skin 128 may be formed from a softer elastomer compound, treated with an appropriate softening solvent or other agent, or heated after assembly to promote conforming, sealing engagement with the insulation layer 82.

Depending on the environment and the configuration of the downhole equipment, the actual materials used and the configuration selected for the connector 28 may vary. The redundant seal systems may comprise various combinations of the seal systems described above. Additional or alternate seal systems may be employed between the cable phases and the connector housing. Furthermore, a variety of spring stacks, lip seals, O-ring seals, and other sealing members may be employed in construction of the connector.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system to create electrical connectivity in a submerged environment, comprising:
- a submersible component;
- a cable to provide electrical communication with the submersible component; and
- a connector coupled to the cable and to the submersible component to enable flow of electricity between the cable and the submersible component, the connector having redundant seal systems, wherein the redundant seal systems enable continued operation of the submersible component in a submerged environment and at temperatures up to at least 600 degrees Fahrenheit, wherein the redundant seal systems comprise an O-ring and an elastomer seal which seals against a phase of the cable and an interior surface of the housing, the elastomer seal being compressed by a compression block driven by a ring that engages a recess in the housing.

2. The system as recited in claim 1, wherein the redundant seal systems comprise a solder joint between a housing of the connector and a lead jacket of the cable.

3. The system as recited in claim 1, wherein the connector further comprises an intervening spring stack between the ring and the elastomer seal.

4. The system as recited in claim 1, wherein the connector further comprises a plurality of insulating shrouds, each insulating shroud being placed over a corresponding phase of a plurality of phases within the housing.

5. The system as recited in claim 2, wherein the solder joint is covered in an encapsulating material.

6. The system as recited in claim 1, wherein the connector further comprises a plurality of phase spring stacks, each phase spring stack being disposed about a corresponding phase of the plurality of phases.

7. The system as recited in claim 1, wherein the elastomer seal comprises a lip seal having an outer skin which is softer than an internal support material.

8. The system as recited in claim 1, wherein the redundant seal systems further comprise a plurality of individual lip seals.

9. The system as recited in claim 1, wherein the insulation layer of the cable comprises an extruded layer.

10. The system as recited in claim 1, wherein the insulation layer of the cable comprises a lapped tape insulation.

11. A system to create electrical connectivity in a submerged environment, comprising:
- a connector for coupling an electric cable to a submersible component, the connector comprising:
  - a housing having openings for receiving phases of the electric cable;
  - a plurality of redundant seal systems to form a sealed connection between the electric cable and the submersible component, the redundant seal systems engaging the housing and comprising:
    - a metal seal system;
    - an O-ring seal system; and
    - a lip seal system to seal between the housing and the individual phases of the electric cable; and
  - a plurality of insulating shrouds, each insulating shroud being placed over a corresponding phase of a plurality of phases within the housing.

12. The system as recited in claim 11, wherein the metal seal system comprises solder located to seal between the housing and an external lead jacket of the electric cable.

13. The system as recited in claim 11, wherein the O-ring seal system comprises an O-ring located around the housing.

14. A method for creating an electrical and mechanical connection in a submerged environment, comprising:

forming a plurality of redundant seal systems capable of operating in a submerged environment at a temperature of up to at least 600 degrees Fahrenheit;

locating the plurality of redundant seal systems along a pothead; and using the pothead to sealingly couple an electric cable with a submersible component, wherein forming comprises forming a lip seal along the pothead and loading the lip seal via at least one spring stack.

15. The method as recited in claim 14, wherein forming further comprises forming a solder seal and an O-ring seal.

16. The method as recited in claim 14, further comprising placing an insulating shroud around each phase of the electric cable within the pothead.

* * * * *